US009303832B2

(12) United States Patent
Sun

(10) Patent No.: US 9,303,832 B2
(45) Date of Patent: Apr. 5, 2016

(54) FLASHLIGHT WITH BENDABLE AND EXTENDABLE BODY

(71) Applicant: Shiyu Sun, Shanghai (CN)

(72) Inventor: Shiyu Sun, Shanghai (CN)

( * ) Notice: Subject to any disclaimer, the term of this patent is extended or adjusted under 35 U.S.C. 154(b) by 61 days.

(21) Appl. No.: 14/223,111

(22) Filed: Mar. 24, 2014

(65) Prior Publication Data

US 2015/0176780 A1 Jun. 25, 2015

(30) Foreign Application Priority Data

Dec. 23, 2013 (CN) ..... 2013 2 0854263 U

(51) Int. Cl.

| | |
|---|---|
| ***F21V 21/088*** | (2006.01) |
| ***F21L 4/04*** | (2006.01) |
| ***F21V 21/14*** | (2006.01) |
| ***F21V 23/04*** | (2006.01) |
| ***F21V 21/096*** | (2006.01) |
| *F21Y 101/02* | (2006.01) |

(52) U.S. Cl.

CPC ..... *F21L 4/04* (2013.01); *F21V 21/088* (2013.01); *F21V 21/0885* (2013.01); *F21V 21/0965* (2013.01); *F21V 21/145* (2013.01); *F21V 23/0414* (2013.01); *F21Y 2101/02* (2013.01)

(58) Field of Classification Search

CPC ..... F21V 21/0885; F21V 21/32
USPC ..... 362/398, 396, 581, 191
See application file for complete search history.

(56) References Cited

U.S. PATENT DOCUMENTS

| | | | | |
|---|---|---|---|---|
| 1,692,394 | A | | 11/1928 | Sundh |
| 2,550,423 | A | | 4/1951 | Nelson |
| 2,581,129 | A | | 1/1952 | Muldoon |
| 3,641,333 | A | * | 2/1972 | Gendron ..... 362/108 |
| 3,992,618 | A | * | 11/1976 | Matthews ..... F21V 21/32 362/396 |
| 4,399,498 | A | * | 8/1983 | Bacevius ..... 362/396 |
| 4,443,831 | A | * | 4/1984 | Godfrey et al. ..... 362/494 |
| 4,495,550 | A | | 1/1985 | Visciano |
| 4,678,153 | A | * | 7/1987 | Maddock ..... F21L 14/02 24/339 |
| 5,176,438 | A | | 1/1993 | Fisherman |
| 5,180,220 | A | * | 1/1993 | Van Kalsbeek ..... 362/98 |
| 5,280,416 | A | | 1/1994 | Hartley et al. |
| 5,385,500 | A | | 1/1995 | Schmidt |
| 5,414,608 | A | * | 5/1995 | Stekelenburg ..... 362/396 |
| 5,442,528 | A | | 8/1995 | Vandenbelt |
| 5,448,463 | A | * | 9/1995 | Leen ..... 362/396 |
| 5,517,392 | A | | 5/1996 | Rousso et al. |
| 5,521,803 | A | | 5/1996 | Eckert et al. |
| 5,567,115 | A | | 10/1996 | Carbone |
| 5,570,949 | A | | 11/1996 | Chiang |
| 5,571,278 | A | | 11/1996 | Chiang |
| 5,571,279 | A | | 11/1996 | Chiang |
| 5,580,151 | A | * | 12/1996 | Chen ..... 362/549 |

(Continued)

*Primary Examiner* — Anh Mai
*Assistant Examiner* — Zachary J Snyder
(74) *Attorney, Agent, or Firm* — Coats & Bennett, PLLC

(57) ABSTRACT

A portable, hand-held flashlight that has a plurality of operative configurations. The flashlight includes a variable intermediate section that allows the flashlight to be in a collapsed configuration or one or more expanded configurations. The flashlight is configured to be repeatedly varied between the collapsed configuration and the expanded configuration(s), with the intermediate section configured to self-retain a shape and length when bent, extended, or collapsed by a user. The flashlight also includes a movable clamp jaw body and a hook that both allow the flashlight to be temporarily mounted to a suitable structure, so that the flashlight does not need to be held by hand while providing illumination. The flashlight may also include magnets.

15 Claims, 6 Drawing Sheets

(56) References Cited

U.S. PATENT DOCUMENTS 5,664,875 A * 9/1997 Hegedus ..... 362/191
5,702,175 A * 12/1997 Chen ..... 362/191
5,707,137 A 1/1998 Hon
5,716,121 A 2/1998 Dubois
5,717,276 A 2/1998 Hsu
5,743,624 A 4/1998 Chiang
5,749,644 A 5/1998 Carbone
5,765,938 A 6/1998 Rousso et al.
5,823,657 A * 10/1998 Price et al. ..... 362/191
5,890,797 A 4/1999 Bish
5,904,414 A * 5/1999 Monteleone et al. ..... 362/205
5,931,560 A * 8/1999 Hoffman ..... 362/124
5,971,562 A 10/1999 Yang
6,004,004 A 12/1999 Altman et al.
6,039,455 A * 3/2000 Sorenson ..... B60R 1/008 248/479
6,062,703 A * 5/2000 Tsao ..... F21L 14/026 362/184
6,168,292 B1 * 1/2001 Sherman ..... 362/287
6,280,050 B1 8/2001 Bird et al.
6,491,408 B1 12/2002 Cooper et al.
D479,888 S 9/2003 Sharrah et al.
6,767,110 B2 7/2004 Cooper et al.
6,854,859 B2 2/2005 Cooper et al.
6,854,861 B2 2/2005 Chao
6,874,908 B2 4/2005 Sharrah et al.
RE38,897 E 11/2005 Krenzel
D536,116 S 1/2007 Sharrah
7,175,295 B2 2/2007 Bretz et al.
7,234,833 B2 * 6/2007 Hatherill et al. ..... 362/198
D557,844 S 12/2007 Shiu
7,322,716 B1 1/2008 Atkinson
7,344,286 B1 * 3/2008 Petrie et al. ..... 362/391
7,467,875 B1 12/2008 Rama
7,510,295 B2 3/2009 Shih
7,705,542 B2 4/2010 Hilt et al.
7,810,967 B2 10/2010 Ko et al.
7,815,337 B2 10/2010 Grossman
8,052,311 B2 11/2011 Xhunga
8,148,917 B2 4/2012 Hilt et al.
D667,976 S 9/2012 Wu
D673,710 S 1/2013 Eichelberger
8,556,450 B2 10/2013 Grossman
D693,042 S 11/2013 Wu
8,777,446 B2 * 7/2014 Sharrah et al. ..... 362/199
2001/0025905 A1 * 10/2001 Carpenter et al. ..... 248/160
2002/0109986 A1 8/2002 Siegel
2002/0145876 A1 * 10/2002 Juang ..... 362/378
2003/0007346 A1 * 1/2003 Cooper et al. ..... 362/184
2003/0007355 A1 * 1/2003 Leen ..... 362/287
2003/0179572 A1 9/2003 Schnell
2004/0090776 A1 5/2004 Yang
2004/0141317 A1 * 7/2004 Sun ..... F21L 4/06 362/198
2004/0151317 A1 8/2004 Hyyppa et al.
2004/0174703 A1 9/2004 Tally
2004/0264180 A1 * 12/2004 Chan ..... F21L 14/02 362/157
2005/0083684 A1 * 4/2005 Kovacik et al. ..... 362/217
2005/0201085 A1 9/2005 Aikawa et al.
2005/0237735 A1 * 10/2005 Fan ..... B60Q 1/2611 362/191
2006/0077672 A1 4/2006 Schaak
2007/0030672 A1 * 2/2007 Offiler et al. ..... 362/198
2007/0223214 A1 9/2007 Yen
2007/0279902 A1 12/2007 Kim
2008/0174991 A1 * 7/2008 Tucker ..... 362/200
2008/0180945 A1 * 7/2008 Shih ..... 362/205
2009/0103290 A1 4/2009 Liu
2009/0141485 A1 * 6/2009 Liu ..... 362/184
2010/0053944 A1 3/2010 Yao-Lin
2010/0085739 A1 * 4/2010 Webb et al. ..... 362/157
2010/0103656 A1 4/2010 Cho
2010/0182780 A1 7/2010 Hilt
2011/0038064 A1 2/2011 Xhunga
2011/0136349 A1 6/2011 Pikielny
2012/0033412 A1 * 2/2012 Molina et al. ..... 362/119
2012/0033437 A1 2/2012 Grossman et al.
2012/0182727 A1 * 7/2012 Sharrah et al. ..... 362/190
2012/0327644 A1 * 12/2012 Woods ..... 362/191
2013/0176715 A1 * 7/2013 Rubino ..... 362/188

* cited by examiner

FLASHLIGHT WITH BENDABLE AND EXTENDABLE BODY

This application claims benefit of Chinese patent application 201320854263X, filed 23 Dec. 2013, the disclosure of which is incorporated by reference herein in its entirety.

BACKGROUND

This application is related to hand-held flashlights that have a variable length.

Hand-held flashlights provide illumination for a wide variety of uses. A conventional flashlight includes a rigid body that is typically cylindrical in shape and fixed in length. While such straight, rigid, and constant length flashlights are useful for many situations, they may be impractical for others. As such, numerous other flashlights with variable configurations have been disclosed. For example, see U.S. Pat. Nos. 1,692,394; 2,550,423; 4,495,550; and 5,385,500. While these alternative flashlight designs are more versatile, their use remains limited. For example, such flashlights may not provide a convenient means for being temporarily mounted to a nearby structure, so that one of the user's hand for such flashlights is occupied by holding the flashlight and not free for other work. As such, there remains a need for alternative flashlight designs, particularly flashlight designs that allow for the light to be directed in various directions, that are variable in size, and that provide convenient temporary mounting means.

SUMMARY

The present invention provides portable, hand-held flashlight that has a plurality of operative configurations. The flashlight includes a variable intermediate section that allows the flashlight to be in a collapsed configuration or one or more expanded configurations. The flashlight is configured to be repeatedly varied between the collapsed configuration and the expanded configuration(s), with the intermediate section configured to self-retain a shape and length when bent, extended, or collapsed by a user. The flashlight also includes a movable clamp jaw body and a hook that both allow the flashlight to be temporarily mounted to a suitable structure, so that the flashlight does not need to be held by hand while providing illumination. The flashlight may also include magnets.

In one or more embodiments, the invention more particularly provides a portable flashlight that includes a proximal base section, a distal head section, and an intermediate section disposed therebetween. The base section is configured to hold a battery therein. The head section has a light source, with the light source configured to selectively receive power from the battery. The intermediate section is bendable and has a length that is variable. The flashlight is variable between a collapsed configuration and an expanded configuration by varying the length of the intermediate section. A distance along the flashlight, between the head section and the base section, is larger in the expanded configuration(s) than in the collapsed configuration. A movable clamp jaw body is permanently and moveably connected to the base section and disposed opposite the head section relative to the base section. The clamp jaw body is selectively deployable toward and away from the base section so as to form a variably sized clamp therewith. A hook is mounted to the clamp jaw body and disposed opposite the base section relative to the clamp jaw body. The hook is movable between a retracted configuration, where the hook is received substantially in the clamp jaw body, and a deployed configuration, where the hook extends proximally away from the clamp jaw body. The flashlight is configured to be repeatedly varied between the collapsed configuration and the expanded configuration, with the intermediate section configured to self-retain a shape and length when bent, extended, or collapsed by a user.

The flashlight may further include at least one magnet mounted to the clamp jaw body and proximally exposed. The hook may include a first hook portion pivotally connected in series with a second hook portion. The light source may include a plurality of LEDs. The head section may include a switch disposed electrically between the battery and the light source, with the switch configured to control an on/off state of the light source. A clamp mechanism that includes the clamp jaw body may also include a shaft connecting the clamp jaw body to the base section, with the shaft permanently and movably mounted to the base section, and an actuator mounted to the base section and engaging the shaft and operative to control an amount of extension of the shaft relative to the base section. A pad may be mounted to the clamp jaw body so as to face the base section. The pad may be movable relative to the clamp jaw body. The flashlight may include multiple batteries, for example a second battery (and advantageously a third battery) connected in electrical series with the first battery. The battery or batteries may electrically connect to the light source via a coiled wire disposed interior of the intermediate section.

The various aspects discussed above may be used alone or in any combination. The various apparatus disclosed herein may operate according to any combination of various methods disclosed herein, and vice versa. Further, the present invention is not limited to the above features and advantages. Indeed, those skilled in the art will recognize additional features and advantages upon reading the following detailed description, and upon viewing the accompanying drawings.

DETAILED DESCRIPTION

The present application is directed to a portable, hand-held flashlight that is variable in size and shape by a user. In general, the flashlight includes a bendable and variable length intermediate section, a clamp mechanism in the lower section of the flashlight, and a selectively deployable hook connect to a portion of the clamp.

Figure 1:
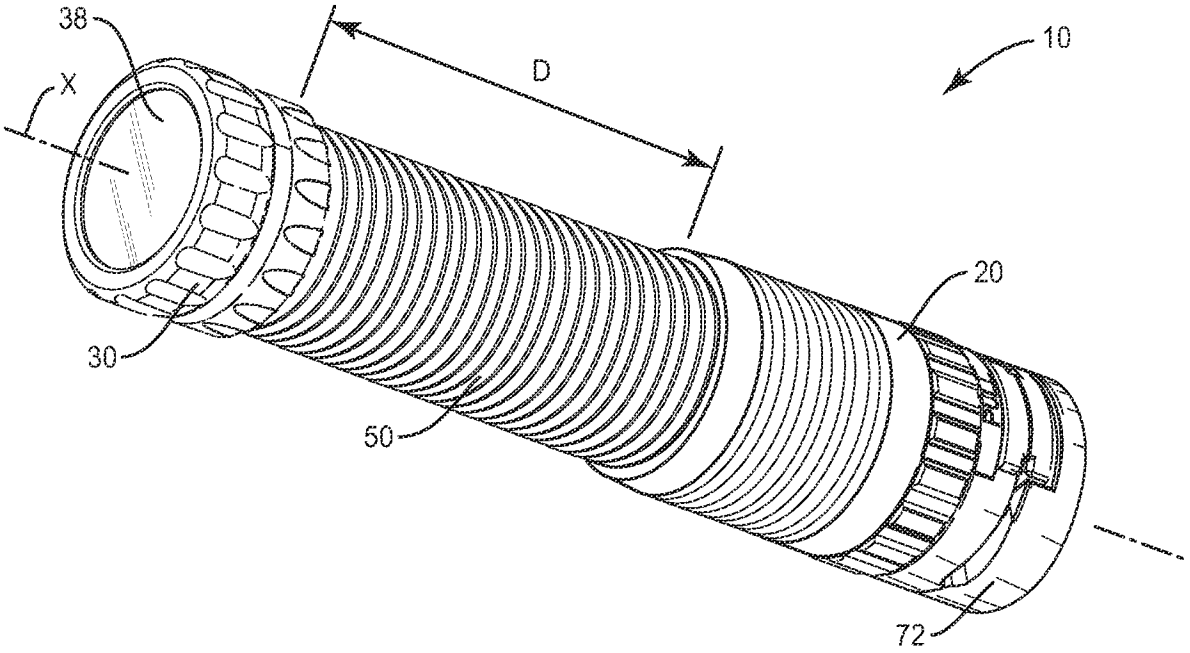
FIG. 1 shows a flashlight according to one or more embodiments, in a collapsed configuration.
Figure 2:
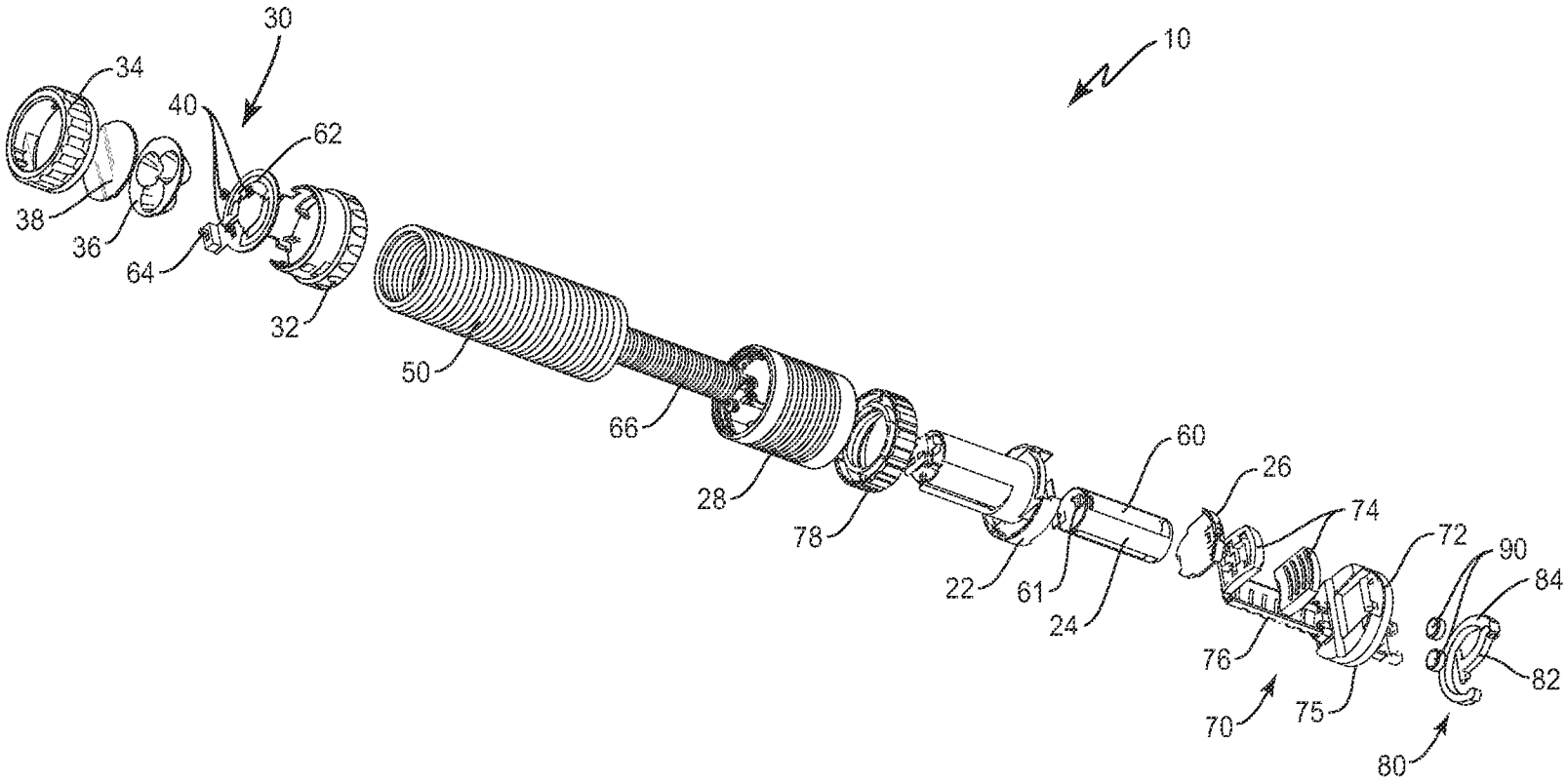
FIG. 2 shows an exploded view of the flashlight of FIG. 1.

Referring to FIGS. 1-2, a flashlight is shown, generally indicated at 10. The flashlight 10 includes a proximal base section 20, a distal head section 30, and an intermediate section 50 that connects the base section 20 to the head section 30. The base section 20 includes a main body 22, and a shell 28. The main body 22 forms a battery cavity that advantageously extends along a centerline of the base section 20. The battery cavity is advantageously configured to receive a battery frame 24 therein, with the battery frame 24 having one or more batteries 60, as discussed further below. The battery cavity is advantageously closed on its distal end (upward, or left in FIGS. 1-2) and selectively closeable on its proximal (lower, or right in FIGS. 1-2) end by a removable access panel 26, which may be slidably engaged with the main body 22 for lateral removal/insertion. The main body 22 forms an exterior portion of the flashlight 10, but also extends into the shell 28 so that the distal end portion of the battery cavity is surrounded by the shell 28. The generally cylindrical shell 28 is affixed to the main body 22 and extends distally toward the head section 30. The shell 28 acts as a mounting point for the proximal end of the intermediate section 50, such as by generally interiorly receiving the proximal end of the intermediate section 50 and/or having a distal annular groove for receiving the proximal intermediate section 50.

The head section 30 includes a housing 32, a bezel 34, a PCB 62, a reflector 36, a shield 38, and a light source 40. The housing 32 may be generally cylindrical and acts as a mounting point for the distal end of the intermediate section 50, such as by generally interiorly receiving the distal end of the intermediate section 50 and/or having a proximal annular groove for receiving the distal end of the intermediate section 50. The bezel 34 is rotatably mounted to the housing 32 and acts as a user-engageable section for controlling the on/off state of the light source 40. The PCB 62 rests in the housing 32, and advantageously includes a switch 64 mounted thereon. The PCB 62 provides a means for routing power from the batteries 60 to the light source 40. The reflector 36 is disposed distally relative to the PCB 62 and provides a means for directing light from the light source 40 in a distal (forward) direction. The shield 38 is disposed distal of the reflector 36 and is advantageously transparent. The bezel 34 help retain the shield 38, reflector 36, and PCB 62 in the housing 32.

The light source 40 advantageously takes the form of a plurality of LEDs which emit a broad spectrum light. For the embodiment of FIG. 1, the light source 40 comprises three LEDs. However, it should be noted that other numbers of LEDs may be employed. Further, the light source 40 may be another light emitting form known in the art suitable for a flashlight, such as one or more conventional incandescent bulbs.

The intermediate section 50 connects the head section 30 to the base section 20. Advantageously, the intermediate section 50 is molded, glued, or otherwise affixed to the housing 32 of the head section 30 and the shell 28 of the base section 20. The intermediate section 50 advantageously takes the form of a hollow tube with a somewhat bellows-type wall structure. A continuous helical groove extends around the wall of the intermediate section 50, with a rounded outer profile, but a creased inner profile that forms a helical fold that functions as a helical hinge section. The intermediate section 50, in its collapsed state, forms a generally straight tube. However, the intermediate section 50 may be extended to an elongated state where the length thereof is increased. In addition, the intermediate section 50 may be bent so as to be non-linear. The intermediate section 50 is configured to stay in a given shape/size until acted on to change its configuration. In other words, the intermediate section 50 does not resiliently self-return to its collapsed state. It should be noted that the intermediate section 50 is configured to be repeatedly and readily moved by a user between its collapsed state (straight and short), an elongated state (straight and longer), and a bent elongated state (longer and bent).

Power for the flashlight 10 is supplied by one or more batteries 60, such as three AAA batteries electrically connected in series. The battery or batteries 60 are received in the battery frame 24, which allows the batteries 60 to be handled as a unit. The battery frame 24 is configured to be received in the batter cavity, advantageously in a keyed fashion to help ensure proper relative positioning. The battery frame 24 may be removed from the battery cavity by removing the access panel 26, as described above. The battery frame 24 includes two terminals 61 (e.g., positive and negative terminals). A resistor may be connected to one terminal 61, if desired. A wire 66, advantageously in the form of a coiled two-conductor wire, is electrically connected to the terminals 61. The wire 66 extends along the interior of the intermediate section 50, from the battery frame 24 to the PCB 62, and provides an electrical path for a power circuit between the batteries 60 and the PCB 60 (and the light source 40, etc.). As can be appreciated, the wire 66 advantageously has inherent mechanical memory so that, when not extended, the wire returns to a relatively tight helical coil similar to a conventional landline telephone handset wire. Of course, other types of wire, or wires, or other conductors known in the art, may alternatively be employed.

Power flow to the light source 40 is controlled by the switch 64. In some embodiments, the switch 64 may be a conventional push-button switch, which may be located at any suitable location on the flashlight 10. Advantageously, however, the switch 64 is located inside the head section 30, and the on/off state of the switch 64 is controlled by the position of bezel 34. The bezel 34 may, for example, include a pair of protrusions on its inner surface, which mechanically interact with the switch 64 to turn the switch 64 on or off depending on the relative rotational position of the bezel 34.

Figure 5:
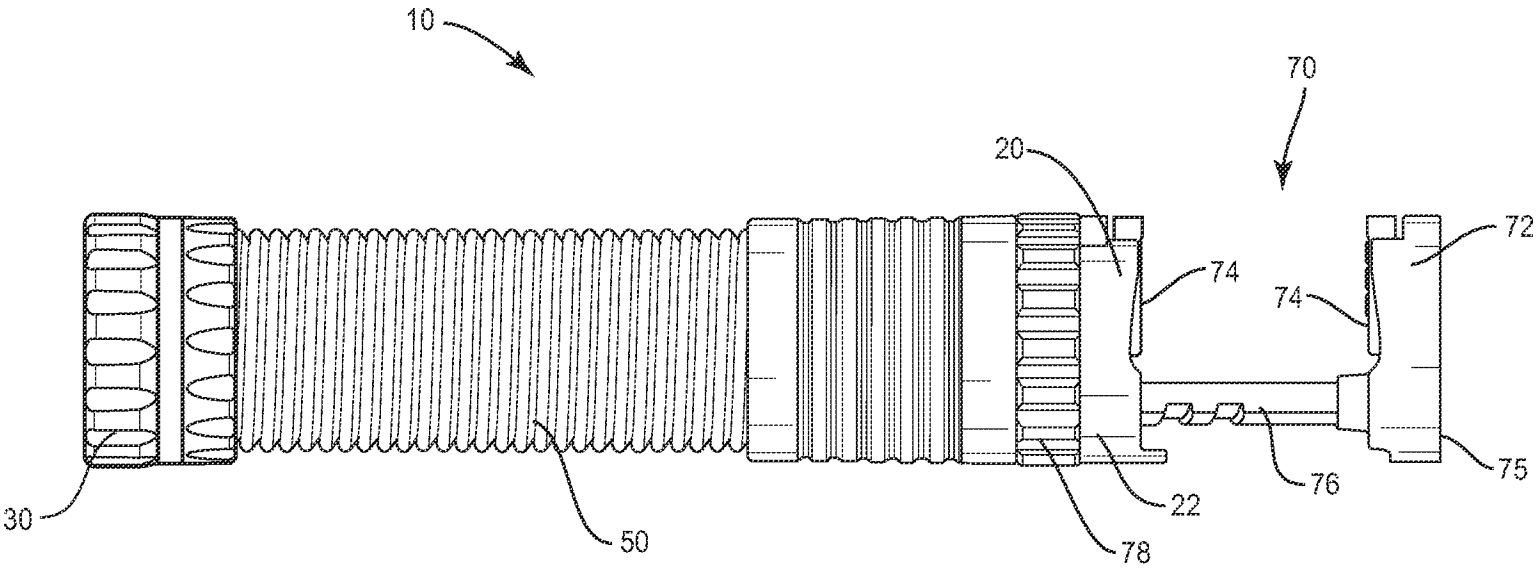
FIG. 5 shows the flashlight of FIG. 1, with the clamp jaw body moved to a more open position.

Referring to FIG. 2 and FIG. 5, a clamp mechanism 70 is moveably mounted to the base section 20. The clamp mechanism 70 includes a moveable jaw body 72, a control shaft 76, and an actuator 78. The moveable jaw body 72 is disposed proximally of the base section 20, with the distal face of the movable jaw body 72 facing the base section 20. The control shaft 76 is affixed to the movable jaw body 72 and movably connects the moveable jaw body 72 to the base section 20. The control shaft 76 extends upward into the base section 20, through the main body 22 and between the main body 22 and the shell 28. The actuator 78 engages the control shaft 76 after it has passed through the main body 22. The actuator 78 may take the form of a ring rotatably mounted to the base section 20, disposed longitudinally between the main body 22 and the shell 28. The actuator 78 includes threading on its inner surface that engages with partial threading on the control shaft 76. Rotation of the actuator 78 in one direction causes the control shaft 76 to extend relative to the base section 20, and rotation of the actuator 78 in the opposite direction causes the control shaft 76 to retract relative to the base section 20. Note that the amount of travel of the movable jaw body 72 should be sufficient to allow suitable space for removal and insertion of the battery frame 24. The proximal face of the main body 22 forms a fixed jaw of the clamp mechanism 70. Thus, a clamp space is formed between the movable jaw body 72 and the proximal face of the main body 22. In some embodiments, suitable cushioning grip pads 74 may be mounted to the moveable jaw body 72 and/or the main body 22 so as to allow for better gripping action for the clamp mechanism. In some embodiments, the pads 74 may be movably mounted so as to be able to pivot proximally/distally to a limited extent.

Figure 6:
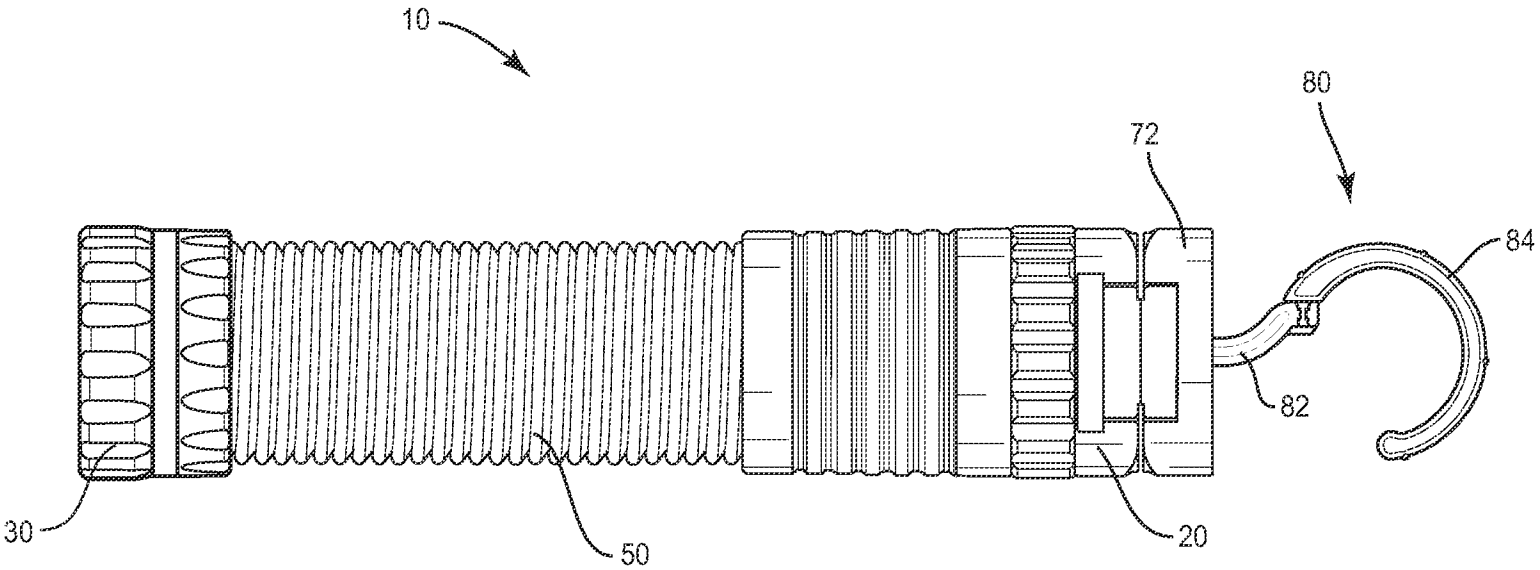
FIG. 6 shows the flashlight of FIG. 1, with the hook deployed.

Referring to FIG. 2 and FIG. 6, a hook 80 is movably attached to the moveable jaw body 72. The hook 80 advantageously includes a first section 82 and a second section 84, with the second section 84 connected to the moveable jaw body 72 via the first section 82. While the hook 80 may be a single unitary body; the second section 84 may be advantageously pivotally mounted to the first section 82, so that the hook 80 is both collapsible and retractable. The hook 80 is movable by the user between a retracted configuration and a deployed configuration. In the retracted configuration, the hook 80 (if multi-part) is folded and received entirely or substantially entirely into an underside of the movable jaw body 72, with a rim flange 75 of the movable jaw body 72 peripherally surrounding the hook 80. In the deployed configuration, the hook 80 is pivoted to extend out proximally away from the moveable jaw body 72. The hook 80 provides a convenient means for handing the flashlight 10 when desired.

In some embodiments, the flashlight 10 may also include one or more magnets 90 for allowing the flashlight 10 to be releasably held to a metal surface. The magnets 90 may be disposed on the proximal face of the moveable jaw body 72. While not required, the magnets 90 are advantageously proximally exposed so as to allow for direct contact with the relevant metal surface. Advantageously, the proximal faces of the magnets 90 are flush with the proximal extent of the moveable jaw body 72.

Figure 3:
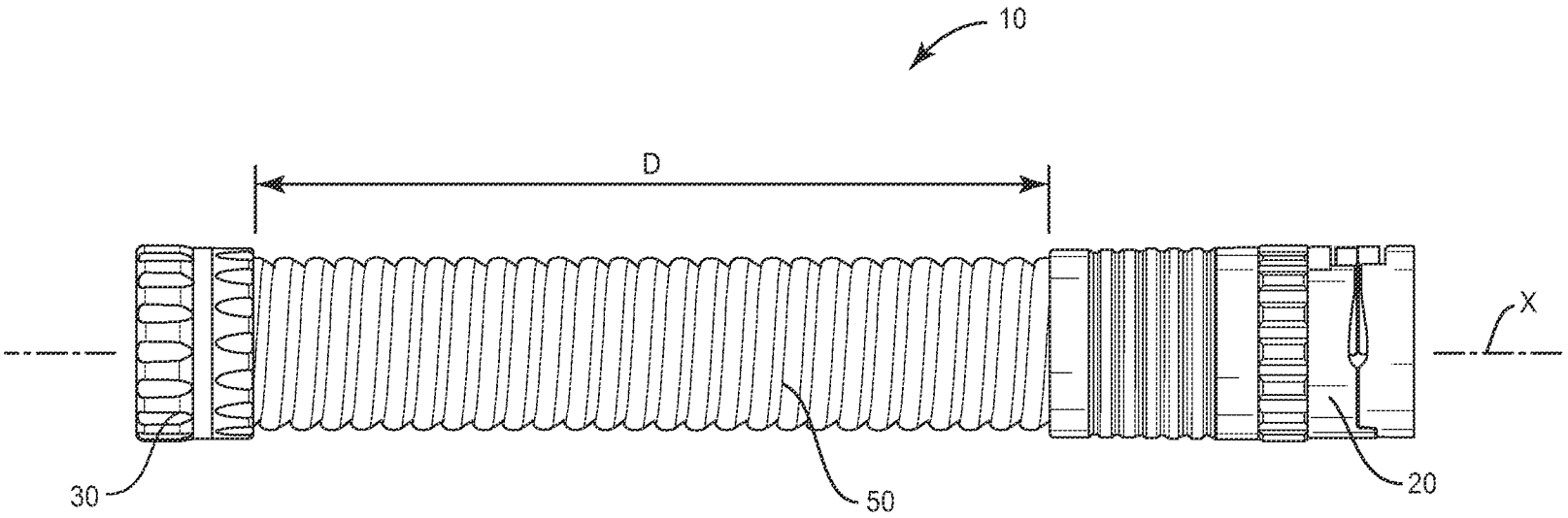
FIG. 3 shows the flashlight of FIG. 1, in a linear expanded configuration.
Figure 4:
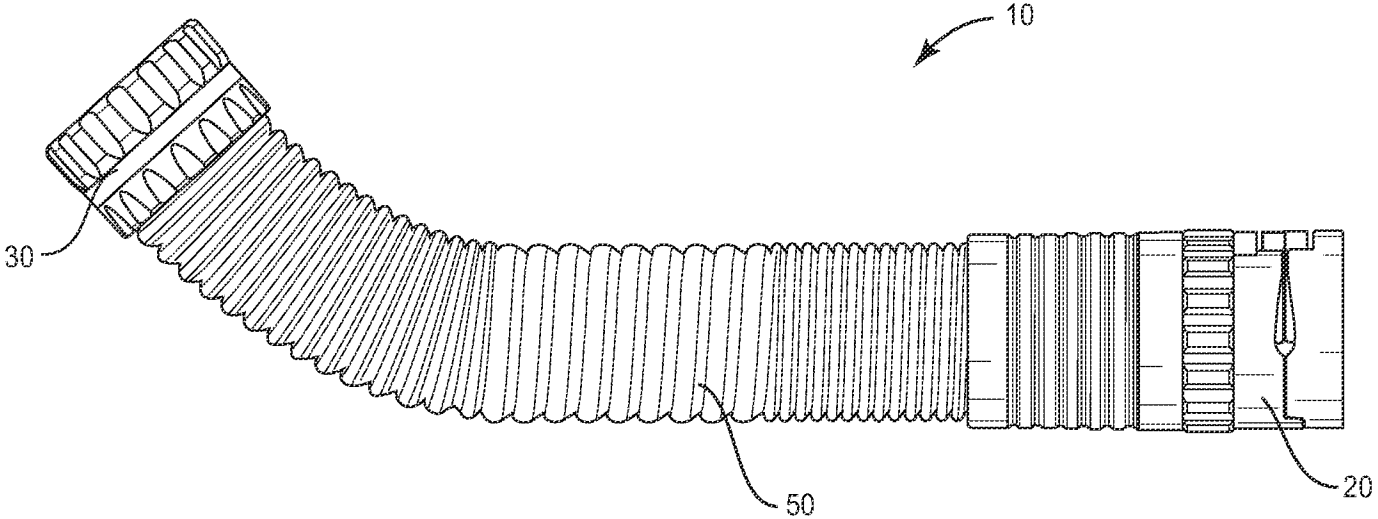
FIG. 4 shows the flashlight of FIG. 3, in another expanded configuration.

The flashlight 10 is movable between a collapsed configuration (FIG. 1) and a plurality of expanded configurations (e.g., FIGS. 3-4) by varying the length of the intermediate section 50. In the collapsed configuration, the head section 30 and the base section 20 are aligned along longitudinal centerline X, and spaced apart a distance D, as measured along the flashlight 10. In a first expanded configuration (FIG. 3), the head section 30 and base section 20 remain aligned, but the distance D is increased. In another expanded configuration (FIG. 4), the intermediate section 50, rather than being straight, is bent at least once, so that head section 30 and base section 20 are not aligned with each other. Of course, other expanded configurations are available because the intermediate section 50 is advantageously bendable and/or extendable anywhere along its length between the based section 20 and the head section 30. Thus, a distance D between the head section 30 and the base section 20, as measured along the flashlight 10, may be varied essentially continuously between a relatively smaller value in the collapsed configuration and a relatively larger value in the various expanded configurations. Further, the flashlight 10 may be either essentially straight (FIG. 1), or may be bent to a desired shape (e.g., FIG. 4) by bending the intermediate section 50. Thus, the flashlight 10 is configured to be repeatedly varied between the collapsed configuration and one or more expanded configurations, with the intermediate section 50 configured to self-retain a shape and length when bent, extended, or collapsed by a user.

The flashlight 10 may be made from any suitable materials, such as plastics, metals, or combinations thereof. For example, the control shaft 76 may be made from metal (e.g., aluminum or a zinc alloy), while the majority of the balance of the flashlight 10 (e.g., other than the PCB 62, magnets 90, and wire 66) may be made from suitable plastics known in the art. The intermediate section 50 is advantageously formed from plastic and steel wire.

In some embodiments, the flashlight 10 may include as secondary light source (not shown) positioned and configured to emit light transverse (e.g., generally perpendicular) to the light emitted by the main light source 40. This secondary light source may be controlled by the same switch 64 as the main light source 40, or may have a separate distinct switch.

The disclosure of all patents and patent publications mentioned above are incorporated herein by reference in their entirety.

The present invention may, of course, be carried out in other specific ways than those herein set forth without departing from the scope of the invention. The present embodiments are, therefore, to be considered as illustrative and not restrictive.

What is claimed is:

1. A portable flashlight, comprising:

a proximal base section, a distal head section, and an intermediate section disposed therebetween along a central axis;

the base section configured to hold a battery therein;

the head section having a light source, the light source configured to selectively receive power from the battery;

the intermediate section being bendable and having a length that is variable; the intermediate section having a bellows-type exterior surface with a helical groove extending therealong;

wherein the flashlight is variable between a collapsed configuration and an expanded configuration by varying the length of the intermediate section, wherein a distance along the flashlight between the head section and the base section is larger in the expanded configuration than in the collapsed configuration;

a movable clamp jaw body permanently and moveably connected to the base section and disposed opposite the head section relative to the base section; the clamp jaw body selectively deployable toward and away from the base section so as to form a variably sized clamp therewith; wherein the clamp is variably sized by linear displacement of the jaw body, along the central axis, relative to the base section;

a hook mounted to the clamp jaw body and disposed opposite the base section relative to the clamp jaw body, the hook movable between a retracted configuration where the hook is received substantially in the clamp jaw body and a deployed configuration where the hook extends proximally away from the clamp jaw body;

wherein the flashlight is configured to be repeatedly varied between the collapsed configuration and the expanded configuration, with the intermediate section configured to self-retain a shape and length when bent, extended, or collapsed by a user;

wherein the bellows-type exterior surface of the intermediate section is configured to expand when moving from the collapsed configuration to the expanded configuration, such that a length thereof increases.

2. The flashlight of claim 1, further comprising at least one magnet mounted to the clamp jaw body and proximally exposed.

3. The flashlight of claim 1, wherein the hook comprises a first hook portion pivotally connected in series with a second hook portion; the first hook portion pivotally mounted to the clamp jaw body; the second hook portion connected to the clamp jaw body via the first hook portion.

4. The flashlight of claim 1, wherein the light source comprises a plurality of LEDs.

5. The flashlight of claim 1, wherein the head section further comprises a switch disposed electrically between the battery and the light source, the switch configured to control an on/off state of the light source.

6. The flashlight of claim 1:

further comprising a shaft connecting the clamp jaw body to the base section, wherein the shaft is permanently and movably mounted to the base section;

further comprising an actuator mounted to the base section and engaging the shaft and operative to control an amount of extension of the shaft relative to the base section.

7. The flashlight of claim 1, wherein a pad is mounted to the clamp jaw body and faces the base section.

8. The flashlight of claim 7, wherein the pad is movable relative to the clamp jaw body.

9. The flashlight of claim 1, wherein the battery is a first battery, and further comprising a second battery connected in electrical series with the first battery.

10. The flashlight of claim 1, wherein the battery electrically connects to the light source via a coiled wire disposed interior of the intermediate section.

11. The flashlight of claim 6, wherein the actuator is a ring rotatably mounted to the base section and is operative to control an amount of extension of the shaft relative to the base section by rotation about the central axis.

12. The flashlight of claim 1, wherein:

the exterior surface of the intermediate section is exposed when the flashlight is in the collapsed configuration with the base section, head section, and intermediate section linearly aligned and a distance between the base section and the head section is at a minimum;

the light source comprises a plurality of LEDs.

13. The flashlight of claim 1, wherein a width of the intermediate section is greater than a majority of a width of the base section in both the collapsed configuration and the expanded configuration.

14. The flashlight of claim 1, wherein the exterior surface of the intermediate section peripherally encloses an interior space of the intermediate section; wherein a length of the interior space increases when moving from the collapsed configuration to the expanded configuration.

15. The flashlight of claim 1, wherein the intermediate section, in the collapsed configuration, forms a generally straight hollow tube.

* * * * *